US005392817A

United States Patent [19]

Seifert et al.

[11] Patent Number: 5,392,817

[45] Date of Patent: Feb. 28, 1995

[54] APPARATUS FOR ALTERING THE LOOP LENGTH OF TERRY CLOTH

[75] Inventors: Eberhard Seifert, Rickenbach-Attikon, Switzerland; Joannes J. H. M. Gorris, Eindhoven, Netherlands

[73] Assignee: Sulzer Brothers Limited, Winterthur, Switzerland

[21] Appl. No.: 868,059

[22] Filed: Apr. 13, 1992

[30] Foreign Application Priority Data

Jun. 11, 1991 [CH] Switzerland ..... 01743/91

[51] Int. Cl.[6] ..... D03D 39/22

[52] U.S. Cl. ..... 139/25

[58] Field of Search ..... 139/25, 26

[56] References Cited

U.S. PATENT DOCUMENTS

| | | | |
|---|---|---|---|
| 3,889,719 | 6/1975 | Seifert | 139/25 |
| 4,566,498 | 1/1986 | Williams et al. | 139/26 |
| 4,721,134 | 1/1988 | Dorman et al. | 139/25 |
| 5,058,628 | 10/1991 | Spiller et al. | 139/26 X |

FOREIGN PATENT DOCUMENTS

| | | |
|---|---|---|
| 0257857 | 3/1988 | European Pat. Off. . |
| 0350446 | 1/1990 | European Pat. Off. . |
| WO91/05895 | 5/1991 | WIPO . |

OTHER PUBLICATIONS

K. H. Kessels: "Die Projektilwebmaschine PU-G und ihr Einsatz im Frottiersektor" in: *Textil Praxis International,* vol. 37, No. 11; Nov. 1, 1982; pp. 1160–1162. No translation.

*Primary Examiner*—Andrew M. Falik

*Attorney, Agent, or Firm*—Townsend and Townsend Khourie and Crew

[57] ABSTRACT

A fabric table (11) of a device (1) for altering a warp pile loop length during terry weaving is brought by a lever system from the starting position (V) into the partial beat-up position (T) and back again into the starting position (v). The lever system comprises a lever (18) and a drive (17, 171) acting at least roughly at right angles on this lever (18). The alteration in the distance (X) between the starting or complete beat-up position (v) and the partial beat-up position (T) of the fabric table (11) is performed by the displacement of the driving point (P) of the drive (17, 171) on the lever (18) and thus of the length of the effective lever arm of the lever (18). The separation achieved changing the position of the fabric table (11) between the complete (v) and the partial (T) beat-up position and of the actual backward and forward movement of the fabric table (11) permits an alteration and adaption of the fabric table travel and thus of the loop length.

22 Claims, 1 Drawing Sheet

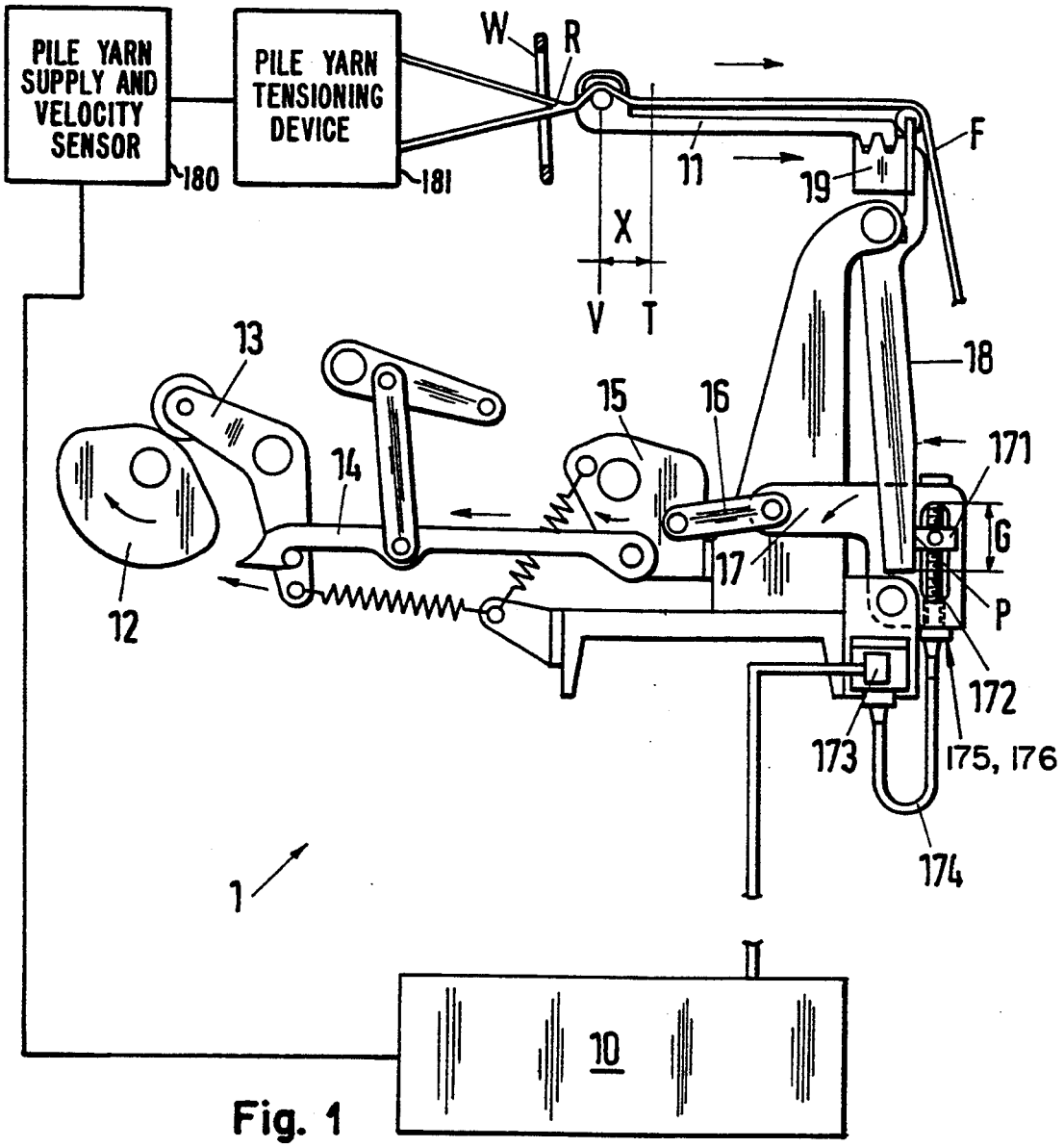
Fig. 1
Fig. 2
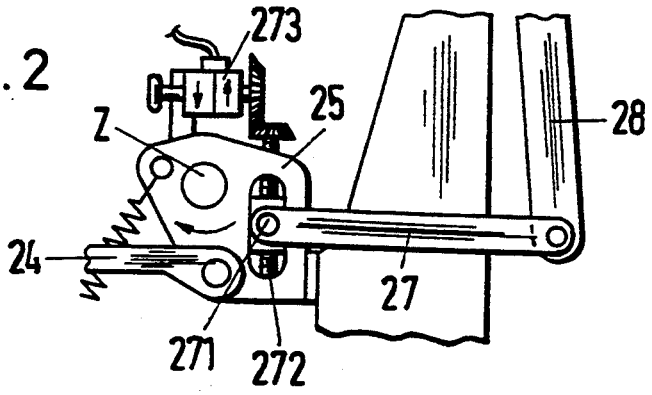

APPARATUS FOR ALTERING THE LOOP LENGTH OF TERRY CLOTH

BACKGROUND OF THE INVENTION

The invention relates to a device for altering the loop length, or loop height respectively, when weaving terry cloth with weaving machines in which the loop formation occurs via the movement of the fabric table.

In terry weaving machines the loops are produced by taking-up a so-called pile warp into the main warp. The take-up of the pile warp is performed with the weft insertion through the shed formed jointly by the pile warp and the main warp.

Terry weaving machines have the peculiarity that with a determined successive number of weft insertions, the weft thread is only partially beaten up, i.e. the weft thread is tied up in the shed, but not completely beaten up by the reed or comb right up to the fabric edge. With these wefts with partial beat-up, the fabric table moves from a starting position into a partial beat-up position further from the comb return point. After the prescribed number of partial beat-ups, a so-called complete beat-up occurs, in which the fabric table is normally brought into the starting position, i.e. into the position nearer the comb return point, the complete beat-up position. There all partially beaten-up weft threads are beaten-up at the fabric edge while the pile warp threads are push upwards and downwards, as a result of which the actual loops of the terry cloth. It is obvious that to define the complete or partial beat-up position, the position of the fabric edge, with respect to the comb return point, is crucial. The position of the fabric edge with respect to the comb return point is thus adjusted with the position of the fabric table.

The backward and forward movement of the fabric table is normally performed with a lever mechanism controlled by a cam.

EP 0,257,857 discloses a device for driving the fabric table in which the point of application of a driving rod on the lever arm can be altered so that the effective travel of the driving rod is shorter or longer.

This device has the disadvantage that to change the loop height a basic travel prescribed by the cam has to be superimposed. This means that with a variation from a desired loop height, in every terry cloth weaving cycle an adjustment device has to perform a correction to the travel which changes the partial beat-up position with respect to the complete beat-up position, i.e. the point of application of the driving rod has to be altered.

Therefore this device has the disadvantage that with each terry cloth weaving cycle the point of application of the driving rod has to be brought out of the starting position into a beat-up position and from there again into the starting position.

This results in a high degree of wear on highly-stressed parts of the actuating drive. However above all the demands on the precision of the device are even higher when the position of the complete and/or partial beat-up position of the fabric table has to be altered frequently.

SUMMARY OF THE INVENTION

An object of the present invention is to create a device to change the loop height, with which for an alteration in the loop height the complete beat-up or starting position remains unchanged and the partial beat-up position is changed quickly via several terry cloth weaving cycles with respect to the complete loop position..

Another object of the present invention is also to create a device to move the fabric table, with which the drive of the lever is to be altered only to the rhythm of the change from the complete beat-up to the partial beat-up positions and back again to the complete beat-up position, i.e. not in every terry weaving cycle. It should also be possible to alter the distance of the displacement between the position of the fabric table by simple means during complete beat-up and during partial beat-up.

According to the invention this is achieved with a loom which has a fabric table for holding the terry cloth that is displaceable over a distance "X" between a starting position and a partial beat-up position. The loom includes a device for altering the loop length during weaving of the terry cloth which has a lever operatively coupled with the table for moving the table over the distance "X" and means for pivoting the lever about a pivot axis to therewith move the table between these positions. A drive which is substantially linearly reciprocable in the pivoting direction of the lever and over a constant distance is operatively coupled to the lever at a location spaced from the pivot axis. The location on the lever can be varied while weaving to thereby change the effective length of the lever arm and correspondingly adjust the distance "X" over which the table travels during weaving. A weaving machine according to the invention has such a device.

The swivelling movements of the lever arm, i.e. the so-called swivelling travel, are converted into the forward and backward movements of the fabric table of the terry weaving machine. If the point of application of the drive on the lever is altered, then the travel of the fabric table is altered even if the amplitude of the drive does not change. By the alteration in the length of the lever arm, i.e. the displacement of the point of application of the lever drive and thus of the effective length of the lever arm, in addition the function of the alteration of the distance between the complete and the partial beat-up position is separated from the function of the actual backward and forward movement of the fabric table during terry cloth weaving. The distance between the point of application of the drive on the lever and its fulcrum is designated as the effective lever length. The point of application of the lever drive on the lever in terry cloth weaving operation is not altered as long as the loop length is correct. With the device according to the invention the complete beat-up position, i.e. the starting position or normal position of the fabric table, remains unchanged, even when the effective lever length is altered. This separation of the two functions results in an increase in the precision of the terry cloth apparatus, i.e. the terry cloth appliance, without additional expensive constructive measures being required.

With a weaving machine which has a device for the formation of loops according to the present invention, it is of course also possible to manufacture terry cloth with loops of varying lengths, i.e. varying loop height, according to a specified design. For this purpose the partial beat-up position is altered according to a preset program.

In fabric-controlled terry apparatus the precise adjustment and simple alteration of the swivel travel of the fabric table is a prerequisite for the precise adjustment of the loop length. The precise adjustment of the loop length is of great importance for the appearance of the fabric. In addition this is important because in the trade of material-intensive terry cloth the weight per piece is an important price factor. Normally variations in weight from the set value of ±2% are tolerated. Larger variations in the downward direction normally result in price reductions to be borne by the weaver. Upward variations in weight, i.e. too heavy terry cloth with the correspondingly higher use of material, also burden the weaver with extra costs without extra proceeds. Thus it is understandable that the weaver is interested in producing terry cloth completely within the tolerated weight limit of +2% and within this tolerance range as near as possible to the set value or even at the lower weight limit.

In this respect a terry appliance having a device as specified by the invention has advantages because it makes it possible to adjust the loop length more precisely.

BRIEF DESCRIPTION OF THE DRAWINGS

FIG. 1 shows a lateral view of a diagrammatically represented terry appliance, in which the position of the fabric table can be altered with a device made according to the present invention; and FIG. 2 shows details of another lever driven according to the invention in a lateral elevation.

DESCRIPTION OF THE PREFERRED EMBODIMENTS

With the terry appliance 1 the fabric table 11 is moved via a system of levers from the starting position, the so-called complete beat-up position V, by distance X into the partial beat-up position T and back again. In the figure the fabric table 11 is shown in starting position V. In this position the reed or comb W, which is shown in its return and beat-up position, performs a complete beat-up. During this process the weft threads are beaten up at the fabric edge R. As a result the loops of a terry cloth are formed by transferring the pile warp threads. The arrows indicate in which direction the various components of the lever system are moved during the displacement by distance X into the partial beat-up position T. On return into the starting or complete beat-up position V, the movement occurs in the opposite direction to that indicated by the arrows. The return movement is assisted by the forces which force the terry cloth F on the terry appliance, in particular on the breast beam 19 and the driving lever 18.

The lever system is driven by cam disc 12. The cam disc drives the roller lever 13, which in turn moves the coupling hook 14. The pulling movement of the coupling hook 14 is transmitted via the intermediate disc 15 and the shackle 16 to the rocker lever 17. The slide ring 171 can be displaced and adjusted transversely, i.e. approximately at least at right angles to the pulling direction of the rocker lever 17, and transmits the movement of the rocker lever 17 to the drive lever 18 and via the mobile breast beam 19 to the fabric table 11.

The amplitude of the backward and forward movements of roller lever 13, coupling hook 14, intermediate disc 15 and shackle 16 with rocker lever 17 remain unchanged. However with the displacement of the point of application P in region G of slide ring 171, the distance by which breast beam 19 with fabric table 11 is withdrawn varies. The distance X between the full beat-up position V and the partial beat-up position T can be therefore very precisely and exactly adjusted and altered. With an alteration and an adjustment in distance X, the loop length of the terry cloth is also altered and adjusted.

The fabric table 11 of device 1 is brought from starting position V by a lever system into the partial beat-up position T and back again into starting position V. The lever system comprises a lever 18 and a drive 17,171 acting at least approximately at right angles on this lever (18). The alteration in the distance X between the starting or complete beat-up position V and the partial beat-up position T of the fabric table 11 is performed by the displacement of the driving point P of drive 17, 171 on the lever 18 and thus of the length of the effective lever arm of lever 18. The separation achieved thereby of the function of the alteration in the position of the fabric table 11 between the complete beat-up position V and the partial beat-up position T from the function of the actual backward and forward movement of the fabric table 11 enables an improvement and-a simplification in the alteration and adaption of the travel of the fabric table (distance X) and thus of the loop length with fabric-controlled terry cloth weaving.

In the example shown in FIG. 1 the displacement of the slide ring 171 is performed with a spindle 172, which is driven by stepping motor 173 via flexible shaft 174. Of course the displacement of the slide ring 171 could also be performed in a different way, e.g. pneumatically, hydraulically with a pneumatic actuator 175 or a hydraulic actuator 176 which suitably move slide ring 171, via a piston rod (not shown) or the like, or via a push-pull cable.

In the example shown in FIG. 1, the position of the slide ring 171 is determined by the control and adjustment electronics 10. A pile yarn supply (not separately shown) includes a pile yarn thread velocity sensor 180 which determines the speed of the pile yarn leaving the pile warp yarn and advancing towards the fabric. In addition, there is a pile yarn tensioning device 181 which, in a known manner, senses and regulates; e.g. keeps constant, the tension of the pile yarn.

The control electronics calculates the set position of the slide ring 171, and thus of the distance X from the starting position V to the partial beat-up position T, for example based on values such as the pile warp velocity, the pile warp tension, the speed of the weaving machine, or the loop thread length per cm terry cloth. In this case the calculation is normally performed by variance comparisons of the values or of products of these values. When the measurement of the actual values is precise enough, the taken-up loop thread length can be controlled and kept in the range of ±2% of the ideal value.

The pile warp or pile thread velocity can lie in the range of between less then one meter to several meters per minute, for example 0.2 to 5 m/min. The speeds of modern terry weaving machines lie within the range of from 150 to over 500 rpm.

FIG. made shows a part of a device 2 according to the invention, in which an intermediate disc 25 which can be rotated around axis Z drives the lever 27 via articulation 271. The effective lever arm of the intermediate disc 25 can be driven by means of the spindle 272, which is driven with a stepping motor 273 via an angular drive. In this example the intermediate disc 25 can also be driven with a coupling hook 24.

Of course a construction in which a spindle is provided at each end of the lever 27 to alter the effective lever length can also be used.

What is claimed;

1. In a loom for weaving terry cloth including a fabric table for holding the terry cloth and displaceable over a distance "X" between a starting position and a partial beat-up position, and a device for altering a loop length during weaving of the terry cloth, the device including a lever operatively coupled with the table for moving the table over the distance "X" and means for pivoting the lever about a pivot axis to therewith move the table between said positions, the improvement to the device comprising a drive substantially linearly reciprocable in a general pivoting direction of the lever and over a constant distance; means operatively coupling the drive to the lever at a location spaced from the pivot axis, and adjustment means operable while terry cloth is being woven on the loom for varying said location on the lever relative to the pivot axis to thereby adjust the distance "X".

2. A loom according to claim 1 wherein the adjustment means comprises a connector coupled to the drive and engaging the lever, and means for moving the connector during operation of the loom relative to the pivot axis of the lever to vary said location and thereby vary the extent to which the lever pivots as the drive reciprocates.

3. A loom according to claim 1 wherein the adjustment means comprises a spindle drive including means movable along a portion of a length of the lever to thereby change the effective length of the lever arm.

4. A loom according to claim 3 wherein the spindle drive includes a stepping motor.

5. A loom according to claim 1 including means for influencing changes in the effective length of the lever arm to thereby change the partial beat-up position of the fabric table.

6. A loom according to claim 2 wherein the adjustment means comprises a spindle drive including means movable along a portion of a length of the lever to thereby change the effective length of the lever arm.

7. A loom according to claim 6 wherein the spindle drive includes a stepping motor.

8. A loom according to claim 2 including means for influencing changes in the effective length of the lever arm to thereby change the partial beat-up position of the fabric table.

9. A loom for weaving terry cloth comprising a fabric table for supporting the cloth and movable between a starting position and a partial beat-up position, a pivotally mounted lever operatively connected with the table for moving the table between said positions, a reciprocating drive acting on the lever generally transversely to its length for pivoting the lever to thereby move the table between said positions, and means operatively coupled with the drive and the lever for changing during weaving of the terry cloth by the loom a location where the drive acts on the lever so that, for a given reciprocating travel of the drive, the extent of pivotal lever motion and therewith the distance between the starting position and the partial beat-up position is changed.

10. A loom according to claim 9 wherein the adjustment means comprises a spindle drive including means movable along a portion of a length of the lever to thereby change the effective length of the lever arm.

11. A loom according to claim 10 wherein the spindle drive includes a stepping motor.

12. A loom according to claim 11 including means for influencing changes in the effective length of the lever arm to thereby change the partial beat-up position of the fabric table.

13. A loom for weaving terry cloth including a terry cloth fabric support table movable between a starting position and a partial beat-up position and a device for altering a loop length of the terry cloth during weaving including a lever operatively coupled to the support table and having an effective lever arm, a drive acting on the lever generally transversely to its length, adjustment means for altering the effective length of the lever arm, whereby activation of the drive results in reciprocating movements of the table between said positions, and a measuring appliance for determining a pile thread velocity including control means having storage means holding set values for the pile thread velocity for adjusting and controlling the pile thread velocity in response to deviations of a measured pile thread velocity from a set pile thread velocity value.

14. A loom according to claim 13 wherein the adjustment means comprises a spindle drive including means movable along a portion of a length of the lever to thereby change the effective length of the lever arm.

15. A loom according to claim 14 wherein the spindle drive includes a stepping motor.

16. A loom according to claim 13 wherein the adjustment means comprises a hydraulic actuator.

17. A loom according to claim 13 wherein the adjustment means comprises a pneumatic actuator.

18. A loom according to claim 13 including means for transmitting a weaving machine velocity to the control means and means for determining the set values of the pile thread velocity from revolutions per minute of the loom and a specified pile length for the terry cloth.

19. A loom according to claim 13 including means for measuring and regulating a tension of the pile warp threads.

20. A loom according to claim 19 including means for keeping a tension of the pile warp threads constant.

21. A loom according to claim 13 including means for influencing changes in the effective length of the lever arm to thereby change the partial beat-up position of the fabric table.

22. A loom for weaving terry cloth including a terry cloth fabric support table movable between a starting position and a partial beat-up position and a device for altering a loop length of pile warp threads of the terry cloth during weaving including a lever operatively coupled to the support table and having an effective lever arm, a drive acting on the lever generally transversely to its length, adjustment means for altering the effective length of the lever arm, whereby activation of the drive results in reciprocating movements of the table between said positions, and means for measuring and regulating a tension of the pile warp threads.

* * * * *